US010731096B2

(12) United States Patent
Han et al.

(10) Patent No.: US 10,731,096 B2
(45) Date of Patent: Aug. 4, 2020

(54) LUBRICANT BASE STOCK BLENDS

(71) Applicant: ExxonMobil Chemical Patents Inc., Baytown, TX (US)

(72) Inventors: Wenning W. Han, Houston, TX (US); Pramod J. Nandapurkar, Seabrook, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 117 days.

(21) Appl. No.: 15/750,342

(22) PCT Filed: Jun. 24, 2016

(86) PCT No.: PCT/US2016/039222

§ 371 (c)(1),
(2) Date: Feb. 5, 2018

(87) PCT Pub. No.: WO2017/034659

PCT Pub. Date: Mar. 2, 2017

(65) Prior Publication Data

US 2018/0230394 A1 Aug. 16, 2018

Related U.S. Application Data

(60) Provisional application No. 62/208,473, filed on Aug. 21, 2015.

(30) Foreign Application Priority Data

Sep. 29, 2015 (EP) ..... 15187365

(51) Int. Cl.

| | |
|---|---|
| ***C10M 111/04*** | (2006.01) |
| ***C10M 101/02*** | (2006.01) |
| ***C10M 107/02*** | (2006.01) |

(52) U.S. Cl.
CPC ..... *C10M 111/04* (2013.01); *C10M 101/02* (2013.01); *C10M 107/02* (2013.01);
(Continued)

(58) Field of Classification Search
CPC .. C10M 111/04; C10M 101/02; C10M 107/02
(Continued)

(56) References Cited

U.S. PATENT DOCUMENTS

| | | | | |
|---|---|---|---|---|
| 3,382,291 A | | 5/1968 | Brennan et al. | |
| 5,602,086 A | * | 2/1997 | Le | C10M 111/04 508/591 |

(Continued)

FOREIGN PATENT DOCUMENTS

| | | |
|---|---|---|
| EP | 1661921 | 5/2006 |
| EP | 1043341 | 10/2008 |

(Continued)

OTHER PUBLICATIONS

"Industrial Technology of Next Generation Polymer by Metallocene Catalyst," (Reference A) title page, p. 993, and publication data (published May 20, 1995), and alleged partial translation provided by third party law firm, Enclosure 2, dated Oct. 4, 2012, Hoffmann EITLE, Patent-und Rechtsanwalte, 81925 Munchen, Arabellastr. 4.

(Continued)

*Primary Examiner* — Ellen M McAvoy

(57) ABSTRACT

Disclosed is a lubricant base stock blend comprising a PAO base stock and an alkylated aromatics (AA) base stock, wherein at least the longer portion of the pendant groups attached to the carbon backbones of the PAO molecules have comparable length to at least the longer portion of the side chain groups attached to the aromatic ring structure of the AA molecules. The comparable lengths of at least the longer portion of the pendant groups and the side chain groups lead to enhanced improvement in oxidation stability of the blend.

25 Claims, 2 Drawing Sheets

(52) U.S. Cl.
CPC ..... *C10M 2203/065* (2013.01); *C10M 2205/0285* (2013.01); *C10M 2205/223* (2013.01); *C10N 2220/024* (2013.01); *C10N 2220/025* (2013.01); *C10N 2220/028* (2013.01); *C10N 2230/10* (2013.01)

(58) Field of Classification Search
USPC ..... 508/591; 585/10, 25
See application file for complete search history.

(56) References Cited

U.S. PATENT DOCUMENTS

| | | | | |
|---|---|---|---|---|
| 6,180,575 | B1 * | 1/2001 | Nipe | C10M 169/045 508/227 |
| 6,846,778 | B2 | 1/2005 | Johnson et al. | |
| 6,858,767 | B1 | 2/2005 | DiMaio et al. | |
| 7,019,091 | B2 | 3/2006 | Minami et al. | |
| 7,053,254 | B2 | 5/2006 | Miller | |
| 7,129,197 | B2 | 10/2006 | Song et al. | |
| 7,241,375 | B2 | 7/2007 | Johnson et al. | |
| 7,344,631 | B2 | 3/2008 | Bishop et al. | |
| 7,589,145 | B2 | 9/2009 | Brant et al. | |
| 7,795,194 | B2 | 9/2010 | Iimura et al. | |
| 7,880,047 | B2 | 2/2011 | Knowles et al. | |
| 8,071,687 | B2 | 12/2011 | Jiang et al. | |
| 8,227,392 | B2 | 7/2012 | Wu et al. | |
| 8,299,007 | B2 * | 10/2012 | Carey | C10M 107/10 208/19 |
| 8,389,780 | B2 | 3/2013 | Knowles et al. | |
| 8,530,712 | B2 | 9/2013 | Wu et al. | |
| 8,748,361 | B2 | 6/2014 | Wu et al. | |
| 8,816,034 | B2 | 8/2014 | Sato et al. | |
| 9,409,834 | B2 | 8/2016 | Wu et al. | |
| 2003/0109389 | A1 * | 6/2003 | Wardlow | C10M 111/04 508/482 |
| 2003/0195128 | A1 | 10/2003 | Deckman et al. | |
| 2005/0049373 | A1 | 3/2005 | Minami et al. | |
| 2008/0042037 | A1 | 2/2008 | Orr | |
| 2008/0177121 | A1 | 7/2008 | Wu et al. | |
| 2009/0005279 | A1 | 1/2009 | Wu et al. | |
| 2009/0036725 | A1 | 2/2009 | Wu et al. | |
| 2009/0088355 | A1 | 4/2009 | Hee et al. | |
| 2009/0247442 | A1 | 10/2009 | Hagemeister et al. | |
| 2010/0087349 | A1 | 4/2010 | Lee et al. | |
| 2010/0317904 | A1 | 12/2010 | Small et al. | |
| 2010/0323937 | A1 | 12/2010 | Wu et al. | |
| 2011/0040052 | A1 | 2/2011 | Bburton et al. | |
| 2011/0082061 | A1 | 4/2011 | Carey et al. | |
| 2011/0092752 | A1 | 4/2011 | Knowles et al. | |
| 2011/0160502 | A1 | 6/2011 | Wu et al. | |
| 2012/0302481 | A1 | 11/2012 | Katayama et al. | |
| 2013/0023633 | A1 | 1/2013 | Holtcamp et al. | |
| 2013/0143783 | A1 * | 6/2013 | Deckman | C10M 105/32 508/459 |
| 2013/0252863 | A1 * | 9/2013 | Cooper | C10M 141/08 508/273 |
| 2013/0303818 | A1 | 11/2013 | Inagaki et al. | |
| 2014/0038872 | A1 * | 2/2014 | Deckman | C10M 107/02 508/572 |
| 2014/0087986 | A1 | 3/2014 | Patil et al. | |
| 2014/0135461 | A1 | 5/2014 | Kohiruimaki et al. | |
| 2014/0187457 | A1 * | 7/2014 | Kanga | C10M 169/04 508/464 |
| 2014/0235909 | A1 | 8/2014 | Shimizu et al. | |
| 2014/0256997 | A1 * | 9/2014 | Shimizu | C08F 210/14 585/12 |
| 2014/0309151 | A1 * | 10/2014 | Shimizu | C08F 210/14 508/591 |
| 2014/0323665 | A1 * | 10/2014 | Wu | C10M 107/10 525/338 |
| 2015/0099679 | A1 | 4/2015 | Yang et al. | |
| 2016/0145512 | A1 * | 5/2016 | Lyon | C10G 69/02 208/19 |
| 2017/0029734 | A1 * | 2/2017 | Yang | C10M 111/04 |
| 2017/0051223 | A1 | 2/2017 | Han | |

FOREIGN PATENT DOCUMENTS

| | | |
|---|---|---|
| EP | 2738185 | 6/2014 |
| EP | 2746302 | 6/2014 |
| EP | 2470571 | 12/2014 |
| JP | 2005200450 | 7/2005 |
| JP | 5357605 | 4/2009 |
| JP | 4283120 | 6/2009 |
| JP | 2010/065072 | 3/2010 |
| JP | 2010/070593 | 4/2010 |
| JP | 5808292 | 6/2012 |
| JP | 2013199517 | 10/2013 |
| JP | 2013199585 | 10/2013 |
| WO | 2005/121280 | 12/2005 |
| WO | 2007/011459 | 1/2007 |
| WO | 2008/042037 | 4/2008 |
| WO | 2009/017953 | 2/2009 |
| WO | 2009/123800 | 10/2009 |
| WO | 2009/148685 | 12/2009 |
| WO | 2011/019541 | 2/2011 |
| WO | 2013/055483 | 4/2013 |
| WO | 2014/065984 | 5/2014 |
| WO | 2014/209712 | 12/2014 |
| WO | 2017/034659 A | 3/2017 |

OTHER PUBLICATIONS

"Living Polymerization by Homogeneous Transition Metal Catalyst," (Reference B) title page, pp. 46 and 47 and page with publication data (published on May 20, 1999), and alleged partial translation provided by third party law firm, Enclosure 3, dated Oct. 4, 2012, Hoffmann.cndot.EITLE, Patent-und Rechtsanwalte, 81925 Mu {umlaut over (n)}chen, Arabellastr. 4.

E. Riedel, Editor, Walter de Gruvter, Berlin, NY, 1999, Modem Inorganic Chemistry, Title page and pp. 696-697, alleged English translation provided by third party law firm. Hoffman EITLE Patent-und Rechtsanwalte, 81925 Munchen, Arabellastr 4.Enclosure 1dated Oct. 4, 2012.

"New Polymer Produced by Metallocene Catalyst," (Reference C) title page, pp. 53-55 and page with publication data (published on Apr. 20, 1999), and alleged partial translation provided by third party law firm, Enclosure 4, dated Oct. 4, 2012, Hoffmann.cndot. EITLE, Patent-und Rechtsanwalte, 81925 Munchen, Arabellastr. 4.

M.M. Wu, Synthetic Lubricants and High Performance Functional Fluids, Marcel Dekker, book. Mar. 1999, pp. 195-213; Chapter 7. Alkylated Aromatics.

M. Sacchi et al., "Use of Different Alkoxysilanes as External Donors in MgClrSupported Ziegler-Hatta Catalysts to Obtain Propene/1-Butene Copolymers With Different Microstructure," Macromolecular Chemistry and Physics, 1994, vol. 195, pp. 2805-2816.

Ewen et al., "Stereoblock Isotactic-Hemiisotatctic Poly(propylene)s and Ethylene/Propylene Copolymers Obtained with ansa-Cyclopenta[1,2-b;4,3-b']dithiophene Catalysts", Macromolecular Chemistry and Physics (2004), 205, pp. 302-307.

Miller, S.A. "Insertion vs. site epimerization with singly-bridged and doubly-bridged metallocene polymerization catalysts", Journal of Organometallic Chemistry (2007), 692, pp. 4708-4716.

Z. Fan et al., "Effect of Ethoxy- and Methoxysilane Donors in Propene/1-Hexene Copolymerization With High-Yield Supported Ziegler-Hatta Catalysts," Macromolecular Chemistry and Physics, 1994, vol. 195, pp. 3889-3899.

Lappin, "Routes to Alpha-Olefins", Alpha Olefins Applications Handbook, Chapter 3, Edited by G. R. Lappin and J. D. Sauer, Marcel Dekker, Inc.,1989.

Rizvi, "Dispersants", Lubricant Additives: Chemistry and Application, Chapter 5, ed. By Leslie R. Rudnick, p. 143-170.

Sequeira, "Lubricant Base Oil Hydrogen Refining Processes" Lubricant Base Oil and Wax Processing , Chapter 6, by Avilino Sequeira, Jr., Marcel Dekker, Inc., NY, 1994, pp. 119-152.

(56) References Cited

OTHER PUBLICATIONS

Han, "Our mPAO platform is expanding: Introducing SpectraSyn EliteTM 300," 2016 China International Lubricants, Base Oils and Additives Conference, Langham Palace, Sep. 19, 2016.

* cited by examiner

LUBRICANT BASE STOCK BLENDS

CROSS-REFERENCE TO RELATED APPLICATIONS

This invention is a National Phase Application of PCT Application Serial No. PCT/US2016/039222 filed Jun. 24, 2016, and claims priority to and the benefit of U.S. Ser. No. 62/208,473 filed Aug. 21, 2015, and European Patent Application 15187365.0 filed Sep. 29, 2015, both of which are incorporated by reference herein. This application is related to U.S. application Ser. No. 15/166,615 filed May 27, 2016, the disclosure of which is fully incorporated herein by reference.

FIELD

The present invention relates to lubricant base stock blends. In particular, the present invention relates to base stock blends comprising a polyalpha-olefin (PAO) base stock and an alkylated aromatic (AA) base stock. The present invention is useful, e.g., in making lubricant base stock blends with enhanced oxidation stability.

BACKGROUND

Lubricants in commercial use today are prepared from a variety of natural and synthetic base stocks admixed with various additive packages and solvents depending upon their intended application. The base stocks can include, e.g., Groups I, II and III mineral oils, gas-to-liquid base oils (GTL), Group IV polyalpha-olefins (PAO) including but not limited to PAOs made by using metallocene catalysts (mPAOs), Group V alkylated aromatics (AA) which include but are not limited to alkylated naphthalenes (ANs), silicone oils, phosphate esters, diesters, polyol esters, and the like.

Manufacturers and users of lubricating compositions desire to improve performance by extending oil drain life of the lubricating composition. Extended drain life is a highly desirable marketing feature of lubricating compositions, especially Group IV/Group V lubricating compositions.

Degree of oxidation of the lubricating composition, also referred to as oxidation stability, affects the oil drain life of the lubricating composition. Oxidative degradation of lubricating composition can lead to damage of metal machinery in which the lubricating composition is used. Such degradation may result in deposits on metal surfaces, the presence of sludge, or a viscosity increase in the lubricating composition.

The kinematic viscosity of a lubricating composition is directly related to the antioxidation performance and degree of oxidation of the lubricating composition. A lubricating composition being used in machinery has experienced oxidative degradation when the kinematic viscosity of lubricating composition reaches a certain level, and the lubricating composition needs to be replaced at that level. Improving the oxidation stability and antioxidation performance of the lubricating composition improves the oil drain life by increasing the amount of time the lubricating composition can be used before being replaced. Various approaches are used to improve the antioxidation performance and extend the oil drain life of Group IV/Group V lubricating compositions. The approaches typically involve increasing the antioxidant additive concentrations of the lubricating composition.

U.S. Pat. No. 6,180,575 to Nipe and assigned to Mobil Oil Corporation discloses lubricating compositions comprising antioxidant additives and API Group II-V base stocks, such as a PAO base stock and alkylated naphthalene base stocks. The antioxidant additives include phenolic antioxidants, such as ashless phenolic compounds, and neutral, or basic metal salts of phenolic compounds. Typical of the dialkyl dithiophosphate salts which may be used are the zinc dialkyl dithiophosphates, especially the zinc dioctyl and zinc dibenzyl dithiophosphates (ZDDP). These salts are often used as anti-wear agents but they have also been shown to possess antioxidant functionality. The antioxidant additives of the '575 patent also include amine type antioxidants, alkyl aromatic sulfides, phosphorus compounds such as phosphites and phosphonic acid esters, and sulfur-phosphorus compounds such as dithiophosphates and other types such as dialkyl dithiocarbamates, e.g. methylene bis(di-n-butyl)dithiocarbamate. The antioxidant additives may be used individually or in combination with one another.

Nonetheless, there is still a need for lubricant base stock blends having improved oxidation stability.

SUMMARY

It has been found, in a surprising manner, that a lubricant base stock blend comprising a PAO base stock and an AA base stock, where the PAO molecules have an average pendant group length comparable to the average side chain group length of the AA base stock, can have significantly improved oxidation stability compared to those blends in which the PAO base stock has a significantly shorter pendant group length than the side chain group length of the AA base stock. Such enhanced oxidation stability is especially pronounced where the PAO base stock is an mPAO and the AA base stock is an AN base stock. Such new blends of PAO base stock and AA base stock can be advantageously used for formulating lubricant oils with extended life and drain intervals.

Thus, a first aspect of the present invention relates to a lubricant base stock blend comprising a PAO base stock and an alkylated aromatic base stock, wherein: each molecule of the PAO base stock comprises a plurality of pendant groups; the longest 5%, by mole, of the pendant groups of all of the molecules of the PAO base stock have an average pendent group length of Lpg(5%); each molecule of the alkylated aromatic base stock comprises one or more side chain group; the longest 5%, by mole, of all of the side chain groups of all of the molecules of the alkylated aromatic base stock have an average side chain group length of Lsc(5%); and the difference between Lsc(5%) and Lpg(5%) is at most 8.0.

A second aspect of the present invention relates to method for producing a lubricant base stock blend with improved oxidation stability, comprising blending a PAO base stock with an alkylated aromatic base stock with the features stated summarily in the previous paragraph and in detail below.

A third aspect of the present invention relates to a composition of matter containing the lubricant base stock with improved stability described summarily in the preceding paragraphs and in detail below.

DETAILED DESCRIPTION

Figure 1:
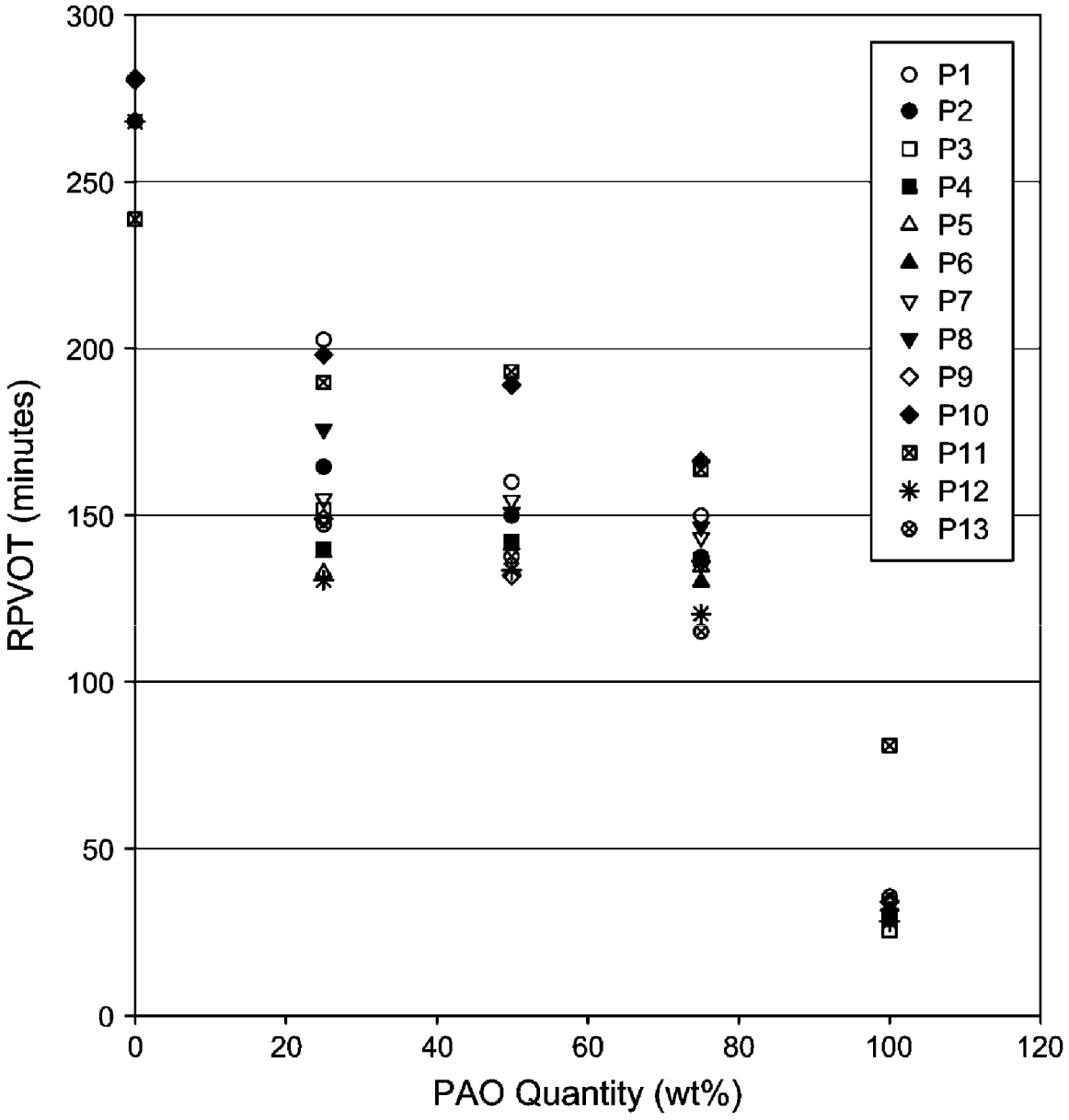
FIG. 1 is a diagram showing oxidation stability performance of a series of lubricant base stock blends comprising a PAO base stock and an AN base stock.

All fluid "viscosities" described herein, unless specified, refer to the 100° C. kinematic viscosities in centistokes ("cSt") measured according to ASTM D445 100° C. ("KV100"). All viscosity index ("VI") values are measured according to ASTM D2270.

As used herein, a "lubricant" refers to a substance that can be introduced between two or more moving surfaces and lower the level of friction between two adjacent surfaces moving relative to each other. A lubricant "base stock" is a material, typically a fluid at the operating temperature of the lubricant, used to formulate a lubricant by admixing with other components. Non-limiting examples of base stocks suitable in lubricants include API Group I, Group II, Group III, Group IV, Group V and Group VI base stocks. Fluids derived from Fischer-Tropsch process or Gas-to-Liquid ("GTL") processes are examples of synthetic base stocks useful for making modern lubricants. GTL base stocks and processes for making them can be found in, e.g., WO2005121280 A1 and U.S. Pat. Nos. 7,344,631; 6,846,778; 7,241,375; 7,053,254.

In the present disclosure, all percentages of pendant groups and side chain groups are by mole, unless specified otherwise.

The PAO Base Stock

PAOs are oligomeric or polymeric molecules produced from the polymerization reactions of alpha-olefin monomer molecules in the presence of a catalyst system, optionally further hydrogenated to remove residual carbon-carbon double bonds therein. Each PAO molecule has a straight carbon chain with the largest number of carbon atoms, which is designated the carbon backbone of the molecule. Any group attached to the carbon backbone other than to the carbon atoms at the very ends thereof is defined as a pendant group. The number of carbon atoms in the longest straight carbon chain in each pendant group is defined as the length of the pendant group. The backbone typically comprises the carbon atoms derived from the carbon-carbon double bonds in the monomer molecules participating in the polymerization reactions, and additional carbon atoms from monomer molecules that form the two ends of the backbone. A typical, hydrogenated PAO molecule can be represented by the following formula (F-1):

(F-1)

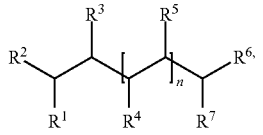

where $R^1$, $R^2$, $R^3$, each of $R^4$ and $R^5$, $R^6$, and $R^7$, the same or different at each occurrence, independently represents a hydrogen or a substituted or unsubstituted hydrocarbyl (preferably an alkyl) group, and n is an non-negative integer corresponding to the degree of polymerization.

Thus, where n=0, (F-1) represents a dimer produced from the reaction of two monomer molecules after a single addition reaction between two carbon-carbon double bonds.

Where n=m, m being a positive integer, (F-1) represents a molecule produced from the reactions of m+2 monomer molecules after m steps of addition reactions between two carbon-carbon double bonds.

Thus, where n=1, (F-1) represents a trimer produced from the reactions of three monomer molecules after two steps of addition reactions between two carbon-carbon double bonds.

Assuming a straight carbon chain starting from $R^1$ and ending with $R^7$ has the largest number of carbon atoms among all straight carbon chain existing in (F-1), that straight carbon chain starting from $R^1$ and ending with $R^7$ having the largest number of carbon atoms constitutes the carbon backbone of the PAO molecule (F-1). $R^2$, $R^3$, each of $R^4$ and $R^5$, and $R^6$, which can be substituted or unsubstituted hydrocarbyl (preferably alkyl) groups, are pendant groups (if not hydrogen).

If only alpha-olefin monomers are used in the polymerization process, and no isomerization of the monomers and oligomers ever occurs in the reaction system during polymerization, about half of $R^1$, $R^2$, $R^3$, all $R^4$ and $R^5$, $R^6$, and $R^7$ would be hydrogen, and one of $R^1$, $R^2$, $R^6$, and $R^7$ would be a methyl, and about half of groups $R^1$, $R^2$, $R^3$, all $R^4$ and $R^5$, $R^6$, and $R^7$ would be hydrocarbyl groups introduced from the alpha-olefin monomer molecules. In a specific example of such case, assuming $R^2$ is methyl, $R^3$, all $R^5$, and $R^6$ are hydrogen, and $R^1$, all $R^4$, and $R^7$ have 8 carbon atoms in the longest carbon chains contained therein, and n=8, then the carbon backbone of the (F-1) PAO molecule would comprise 35 carbon atoms, and the average pendant group length of the pendant groups ($R^2$, all of $R^4$) would be 7.22 (i.e., (1+8*8)/9). This PAO molecule, which can be produced by polymerizing 1-decene using certain metallocene catalyst systems described in greater detail below, can be represented by formula (F-2) below:

(F-2)

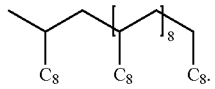

In this molecule, the longest 5%, 10%, 20%, 40%, 50%, and 100% of the pendant groups have average pendant group length of Lpg(5%) of 8, Lpg(10%) of 8, Lpg(20%) of 8, Lpg(50%) of 8, and Lpg(100%) of 7.22, respectively.

Depending on the polymerization catalyst system used, however, different degrees of isomerization of the monomers and/or oligomers can occur in the reaction system during the polymerization process, resulting in different degrees of substitution on the carbon backbone. In a specific example of such case, assuming $R^2$, $R^3$, all $R^5$ are methyls, and $R^6$ is hydrogen, $R^1$ has 8 carbon atoms in the longest straight carbon chain contained therein, and all $R^4$ and $R^7$ have 7 carbon atoms in the longest straight carbon chain contained therein, and n=8, then the carbon backbone of the (F-1) PAO molecule would comprise 34 carbon atoms, and the average pendant group length of the pendant groups ($R^2$, all $R^4$, and R5) would be 3.67 (i.e., (1+1+7*8+1*8)/18). This PAO molecule, which may be produced by polymerizing 1-decene using certain non-metallocene catalyst systems described in greater detail below, can be represented by the following formula (F-3):

(F-3)

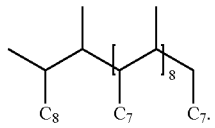

In this molecule, the longest 5%, 10%, 20%, 40%, 50%, and 100% of the pendant groups have average pendant group lengths of Lpg(5%) of 7, Lpg(10%) of 7, Lpg(20%) of 7, Lpg(50%) of 6.3, and Lpg(100%) of 3.67, respectively.

One skilled in the art, with knowledge of the molecular structure or the monomer used in the polymerization step for making the PAO base stock, the process conditions (catalyst used, reaction conditions, e.g.), and the polymerization reaction mechanism, can determine the molecular structure of the PAO molecules, and hence the pendant groups attached to the carbon backbone, and hence the Lpg(5%), Lpg(10%), Lpg(20%), Lpg(50%), and Lpg(100%), respectively.

Alternatively, one skilled in the art can determine the Lpg(5%), Lpg(10%), Lpg(20%), Lpg(50%), and Lpg(100%) values of a given PAO base stock material by using separation and characterization techniques available to polymer chemists. For example, gas chromatography/mass spectroscopy machines equipped with boiling point column separator can be used to separate and identify individual chemical species and fractions; and standard characterization methods such as NMR, IR, and UV spectroscopy can be used to further confirm the structures.

PAO base stocks useful for the blend of the present invention may be a homopolymer made from a single alpha-olefin monomer or a copolymer made from a combination of two or more alpha-olefin monomers.

Preferable PAO base stocks useful for the blend of the present invention are produced from an alpha-olefin feed comprising one or more alpha-olefin monomers having an average number of carbon atoms in the longest straight carbon chain thereof in a range from Nc1 to Nc2, where Nc1 and Nc2 can be, e.g., 6.0, 6.5, 7.0, 7.5, 8.0, 8.5, 9.0, 9.5, 10.0, 10.5, 11.0, 11.5, 12.0, 12.5, 13.0, 13.5, 14.0, 14.5, 15.0, 15.5, or 16.0, as long as Nc1<Nc2. The "alpha-olefin feed" may be continuous or batch-wise. Each of the alpha-olefin monomer may comprise from 4 to 32 carbon atoms in the longest straight carbon chain therein. Preferably, at least one of the alpha-olefin monomer is a linear alpha-olefin (LAO). Preferably, the LAO monomers have even number of carbon atoms. Non-limiting examples of the LAOs include but are not limited to 1-butene, 1-pentene, 1-hexene, 1-heptene, 1-octene, 1-nonene, 1-decene, 1-undecene, 1-dodecene, 1-tridecene, 1-tetradecene, 1-pentadecene, 1-hexadecene, 1-heptadecene, 1-octadecene, 1-nonadecene, 1-eicosene, 1-heneicosene, 1-docosene, 1-tricosene, 1-tetracosene in yet another embodiment. Preferred LAO feeds are 1-hexene, 1-octene, 1-decene, 1-dodecene, 1-tetradecene, 1-hexadecene and 1-octadecene. Preferably, the alpha-olefin feed comprises ethylene at a concentration not higher than 1.5 wt % based on the total weight of the alpha-olefin feed. Preferably, the alpha-olefin feed is essentially free of ethylene. Examples of preferred LAO mixtures as monomers for making the PAO useful in the blend of the present invention include, but are not limited to: C6/C8; C6/C10; C6/C12; C6/C14; C6/C16; C6/C8/C10; C6/C8/C12; C6/C8/C14; C6/C8/C16; C8/C10; C8/C12; C8/C14; C8/C16; C8/C10/C12; C8/C10/C14; C8/C10/C16; C10/C12; C10/C14; C10/C16; C10/C12/C14; C10/C12/C16; and the like.

During polymerization, the alpha-olefin monomer molecules react with components in or intermediates formed from the catalyst system and/or each other, resulting in the formation of covalent bonds between carbon atoms of the carbon-carbon double bonds of the monomer molecules, and eventually, an oligomer or polymer formed from multiple monomer molecules. The catalyst system may comprise a single compound or material, or multiple compounds or materials. The catalytic effect may be provided by a component in the catalyst system per se, or by an intermediary formed from reaction(s) between components in the catalyst system.

The catalyst system may be a conventional catalyst based on a Lewis acid such as $BF_3$ or $AlCl_3$, or a Friedel-Crafts catalyst. During polymerization, the carbon-carbon double bonds in some of the olefin molecules are activated by the catalytically active agent, which subsequently react with the carbon-carbon double bonds of other monomer molecules. It is known that the thus activated monomer and/or oligomers may isomerize, leading to a net effect of the shifting or migration of the carbon-carbon double bonds and the formation of multiple short-chain pendant groups, such as methyl, ethyl, propyl, and the like, on the carbon backbone of the final oligomer or polymer macromolecules. Therefore, the average pendant group length of PAOs made by using such conventional Lewis acid-based catalysts can be relatively low.

Alternatively or additionally, the catalyst system may comprise a non-metallocene Ziegler-Natta catalyst. Alternatively or additionally, the catalyst system may comprise a metal oxide supported on an inert material, e.g., chromium oxide supported on silica. Such catalyst system and use thereof in the process for making PAOs are disclosed in, e.g., U.S. Pat. No. 4,827,073 (Wu); U.S. Pat. No. 4,827,064 (Wu); U.S. Pat. No. 4,967,032 (Ho et al.); U.S. Pat. No. 4,926,004 (Pelrine et al.); and U.S. Pat. No. 4,914,254 (Pelrine), the relevant portions thereof are incorporated herein by reference in its entirety.

Preferably, the catalyst system comprises a metallocene compound and an activator and/or cocatalyst. Such metallocene catalyst system and method for making metallocene mPAOs using such catalyst systems are disclosed in, e.g., WO 2009/148685 A1, the content of which is incorporated herein by reference in its entirety.

Generally, when a supported chromium oxide or metallocene-containing catalyst system is used, isomerization of the olefin monomers and/or the oligomers occurs less frequently, if at all, than when a conventional Lewis acid-based catalyst such as $AlCl_3$ or $BF_3$ is used. Therefore, the average pendant group length of PAOs made by using these catalysts (i.e., mPAOs and chromium oxide PAOs, or chPAOs), can reach or approach the theoretical maximum, i.e., where no shifting of the carbon-carbon double bonds occurs during polymerization. Therefore, in the blend of the present invention, PAO base stocks made by using metallocene catalysts or supported chromium oxide catalysts (i.e., mPAOs and chPAOs) are preferred, assuming the same monomer(s) is used.

Thus, in the blend of the present invention, the PAO base stock comprises a plurality of oligomeric and/or polymeric PAO molecules, which may be the same or different. Each PAO molecule comprise a plurality of pendant groups, which may be the same or different, and the longest 5%, 10%, 20%, 40%, 50%, and 100% of the pendant groups of all of the molecules of the PAO base stock have an average pendent group length of Lpg(5%), Lpg(10%), Lpg(20%), Lpg(40%), Lpg(50%), and Lpg(100%), respectively. It is preferred that at least one of the following conditions is met:

(i) $a1 \leq Lpg(10\%) \leq a2$, where a1 and a2 can be, independently, 7.0, 7.5, 8.0, 8.5, 9.0, 9.5, 10.0, 10.5, 11.0, 11.5, or 12.0, as long as $a1<a2$;

(ii) $b1 \leq Lpg(10\%) \leq b2$, where b1 and b2 can be, independently, 7.0, 7.5, 8.0, 8.5, 9.0, 9.5, 10.0, 10.5, 11.0, 11.5, or 12.0, as long as $b1<b2$;

(iii) c1≤Lpg(20%)≤c2, where c1 and c2 can be, independently, 6.5, 7.0, 7.5, 8.0, 8.5, 9.0, 9.5, 10.0, 10.5, or 11.0, as long as c1<c2;

(iv) d1≤Lpg(40%)≤d2; where d1 and d2 can be, independently, 6.0, 6.5, 7.0, 7.5, 8.0, 8.5, 9.0, 9.5, 10.0, 10.5, or 11.0, as long as d1<d2;

(v) e1≤Lpg(50%)≤e2; where e1 and e2 can be, independently, 5.5, 6.0, 6.5, 7.0, 7.5, 8.0, 8.5, 9.0, or 9.5, as long as e1<e2; and (vi) f1≤Lpg(100%)≤f2, where f1 and f2 can be, independently, 5.0, 5.5, 6.0, 6.5, 7.0, 7.5, 8.0, 8.5, or 9.0, as long as f1<f2.

Preferably, at least 60% of the pendent groups on the PAO molecules in the PAO base stock are straight chain alkyls having at least 6 carbon atoms. Preferably, at least 90% of the pendent groups on the PAO molecules in the PAO base stock are straight chain alkyls having at least 6 carbon atoms. Preferably, at least 60% of the pendent groups on the PAO molecules in the PAO base stock are straight chain alkyls having at least 8 carbon atoms. Preferably, at least 90% of the pendent groups on the PAO molecules in the PAO base stock are straight chain alkyls having at least 8 carbon atoms.

The PAO base stock useful in the present invention may have various levels of regio-regularity. For example, each PAO molecule may be substantially atactic, isotactic, or syndiotactic. The PAO base stock, however, can be a mixture of different molecules, each of which can be atactic, isotactic, or syndiotactic. Without intending to be bound by a particular theory, however, it is believed that regio-regular PAO molecules, especially the isotactic ones, due to the regular distribution of the pendant groups, especially the longer ones, tend to align better with the AA base stock molecules, as discussed below, and therefore preferred. Thus, it is preferred that at least 50%, or 60%, or 70%, or 80%, or 90%, or even 95%, by mole, of the PAO base stock molecules are regio-regular. It is further preferred that at least 50%, or 60%, or 70%, or 80%, or 90%, or even 95%, by mole, of the PAO base stock molecules are isotactic. PAO base stocks made by using metallocene catalysts can have such high regio-regularity (syndiotacticity or isotacticity), and therefore are preferred. For example, it is known that a metallocene-based catalyst system can be used to make PAO molecules with over 95%, or even substantially 100% isotacticity.

The PAO base stock useful for the present invention can have various viscosity. For example, it may have a KV100 in a range from 1 to 5000 cSt, such as 1 to 3000 cSt, 2 to 2000 cSt, 2 to 1000 cSt, 2 to 800 cSt, 2 to 600 cSt, 2 to 500 cSt, 2 to 400 cSt, 2 to 300 cSt, 2 to 200 cSt, or 5 to 100 cSt. The exact viscosity of the PAO base stock can be controlled by, e.g., monomer used, polymerization temperature, polymerization residence time, catalyst used, concentration of catalyst used, distillation and separation conditions, and mixing multiple PAO base stocks with different viscosity.

In general, it is desired that the PAO base stock used in the blend of the present invention has a bromine number in a range from Nb(PAO)1 to Nb(PAO)2, where Nb(PAO)1 and Nb(PAO)2 can be, independently, 0, 0.2, 0.4, 0.5, 0.6, 0.8, 1.0, 1.5, 2.0, 2.5, 3.0, 3.5, 4.0, 4.5, 5.0, as long as Nb(PAO)1<Nb(PAO)2. To reach such a low bromine number, it may be desired that the PAO used in the blend of the present invention has been subjected to a step of hydrogenation where the PAO has been in contact with a $H_2$-containing atmosphere in the presence of a hydrogenation catalyst, such as Co, Ni, Ru, Rh, Ir, Pt, and combinations thereof, such that at least a portion of the residual carbon-carbon double bonds present on the PAO molecules are saturated.

Examples of commercial PAO base stocks useful for the blend of the present invention include, but are not limited to: Spectrasyn synthetic non-metallocene PAO base stocks, Spectrasyn Ultra™ series chromium oxide-based PAO base stocks, and Spectrasyn Elite™ series mPAO base stocks, all available from ExxonMobil Chemical Company located at Houston, Tex., U.S.A.

The Alkylated Aromatic Base Stock

An alkylated aromatic base stocks ("AA base stock") useful in the present invention comprise molecules that may be represented by the following formula (F-4):

(F-4)

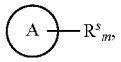

where circle A represents an aromatic ring structure such as the substituted or unsubstituted ring structure, single or fused, of benzene, biphenyl, triphenyl, naphthalene, anthracene, phenanthrene, benzofuran, and the like, and $R^s$, the same or different at each occurrence, independently represents a substituted or unsubstituted hydrocarbyl group (preferably an alkyl group) attached to the aromatic ring structure, and m is a positive integer. Each $R^s$ is defined as a side chain group. The total number of carbon atoms in the longest straight carbon chain in each $R^s$ is defined as the length of the side chain group. Thus, as specific examples of formula (F-4) compounds, 2-n-dodecyl-7-n-dodecyl-naphthalene would have an average side chain group length of 12, while 1-methyl-7-n-dodecyl-naphthalene would have an average side chain group length of 6.5. Their structures are illustrated as follows in formulae (F-5) and (F-6), respectively:

(F-5)

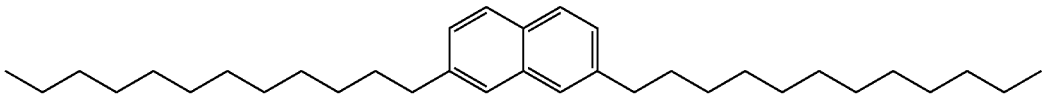

, and (F-6)

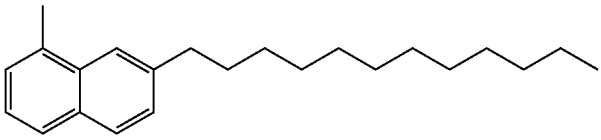

.

Preferred AA base stocks include alkylated naphthalenes base stock ("AN base stock") having a naphthalene ring to which one or more substituted or non-substituted alkyl side chain group(s), the same or different, is attached. For example, a preferred AN base stock comprises a mixture of n-C16-alkyl substituted naphthalenes, 1-methyl-n-C15-alkyl substituted naphthalenes at the one or more locations on the naphthallene nucleus. Such AN base stock is commercially available from ExxonMobil Chemical Company, Houston, Tex., U.S.A., as Synnestic™ AN. For the purpose of the present application, the n-C16-alkyl side chain group is considered to have a side group length (Lsc) of 16, and the 1-methyl-C15-alkyl is considered to have a Lsc of 15. Thus, for 1-n-C16-alkyl-2-(1-methyl-1-n-C15-alkyl)-naphthalene, the average Lsc of the longest 5%, 10%, 20%, 40%, 50%, and 100% of the side chain groups, which are referred to as Lsc(5%), Lsc(10%), Lsc(20%), Lsc(40%), Lsc(50%), and Lsc(100%), respectively, are 16, 16, 16, 16, 16, 15.5, respectively.

In general, it is desired that the AA base stock molecules in the blends of the present invention have an average side chain group length of the longest 5 of the side chain groups of Lsc(5%) in a range from Lsc(5%)1 to Lsc(5%)2, where Lsc(5%)1 and Lsc(5%)2 can be, independently, 10, 11, 12, 13, 14, 15, 16, 17, 18, 19, 20, as long as Lsc(5%)1<Lsc(5%)2.

In general, it is desired that the AA base stock molecules in the blends of the present invention have an average side chain group length of the longest 10% of the side chain groups of Lsc(10%) in a range from Lsc(10%)1 to Lsc(10%)2, where Lsc(10%)1 and Lsc(10%)2 can be, independently, 10, 11, 12, 13, 14, 15, 16, 17, 18, 19, 20, as long as Lsc(10%)1<Lsc(10%)2.

It is further desired that the AA base stock molecules in the blends of the present invention have an average side chain group length of the longest 20% of the side chain groups of Lsc(20%) in a range from Lsc(20%)1 to Lsc(20%)2, where Lsc(20%)1 and Lsc(20%)2 can be, independently, 10, 11, 12, 13, 14, 15, 16, 17, 18, 19, 20, as long as Lsc(20%)1<Lsc(20%)2.

It is further desired that the AA base stock molecules in the blends of the present invention have an average side chain group length of the longest 40% of the side chain groups of Lsc(40%) in a range from Lsc(40%)1 to Lsc(40%)2, where Lsc(40%)1 and Lsc(40%)2 can be, independently, 10, 11, 12, 13, 14, 15, 16, 17, 18, 19, 20, as long as Lsc(40%)1<Lsc(40%)2.

It is further desired that the AA base stock molecules in the blends of the present invention have an average side chain group length of the longest 50% of the side chain groups of Lsc(50%) in a range from Lsc(50%)1 to Lsc(50%)2, where Lsc(50%)1 and Lsc(50%)2 can be, independently, 10, 11, 12, 13, 14, 15, 16, 17, 18, 19, 20, as long as Lsc(50%)1<Lsc(50%)2.

It is further desired that the AA base stock molecules in the blends of the present invention have an average side chain group length of all of the side chain groups of Lsc(100%) in a range from Lsc(100%)1 to Lsc(100%)2, where Lsc(100%)1 and Lsc(100%)2 can be, independently, 10, 11, 12, 13, 14, 15, 16, 17, 18, 19, 20, as long as Lsc(100%)1<Lsc(100%)2.

One skilled in the art, with knowledge of the molecular structure or the chemicals used in process for making the AA base stock, the process conditions (catalyst used, reaction conditions, e.g.), and the reaction mechanism, can determine the molecular structure of the AA base stock molecules, and hence the side chain groups attached to the aromatic ring, and hence the Lsc(5%), Lsc(10%), Lsc(20%), Lsc(50%), and Lsc(100%), respectively.

Alternatively, one skilled in the art can determine the Lsc(5%), Lsc(10%), Lsc(20%), Lsc(50%), and Lsc(100%) values of a given AA base stock material by using separation and characterization techniques available to organic chemists. For example, gas chromatography/mass spectroscopy machines equipped with boiling point column separator can be used to separate and identify individual chemical species and fractions; and standard characterization methods such as NMR, IR, and UV spectroscopy can be used to further confirm the structures.

Desirably, in the blend of the present invention, the alkylated aromatic base stock has a bromine number in the range from Nb(AA)1 to Nb(AA)2, where Nb(AA)1 and Nb(AA)2 can be, independently, 0, 0.2, 0.4, 0.5, 0.6, 0.8, 1.0, 1.5, 2.0, 2.5, 3.0, as long as Nb(AA)1<Nb(AA)2.

The AA base stock useful in the blend of the present invention may be produced by, e.g., alkylating an aromatic compound by an alkylating agent in the presence of an alkylation catalyst. For example, alkylbenzene base stocks can be produced by alkylation of benzene or substituted benzene by a LAO, alkyl halides, alcohols, and the like, in the presence of a solid acid such as zeolites. Likewise, alkylated naphthalene bases stocks can be produced by alkylation of naphthalene or substituted benzene by a LAO, alkyl halides, alcohols, and the like, in the presence of a solid acid such as zeolites.

Blends

Different types of base stocks may be blended to form a formulated lubricant composition to provide desired properties of the lubricant composition. In certain situations, the molecules of these different types of base stocks may interact to produce a synergistic effect. For example, it is known that conventional PAO base stocks, when mixed with alkylated naphthalene base stocks, enhanced oxidation stability can be achieved. Such effect is described in, e.g., U.S. Pat. No. 5,602,086.

The base stock blend of the present invention comprises a PAO base stock and an AA base stock, each described in detail above.

We have found, in a surprising manner, significantly higher improvement in oxidation stability can be achieved by blending a PAO base stock with an AA base stock, if the pendant group length (Lpg) of pendant groups, especially the longer pendant groups (e.g., the longest 5%, 10%, 20%, 40%, or 50%), attached to the carbon backbone of the PAO molecules are comparable to the side chain group length (Lsc) of the side chain groups, especially the longer side chain groups (e.g., the longest 5%, 10%, 20%, 40%, or 50%), attached to the aromatic ring structure of the AA molecules. In general, the smaller the difference between Lpg and Lsc, the more pronounced the improvement in oxidation stability of the blend. This phenomenon has never been observed previously.

Without intending to be bound by a particular theory, it is believed that comparable lengths of the longer pendant groups on the PAO carbon backbone and the side chain groups on the aromatic ring structure lead to better alignment, stronger affinity or interaction (e.g., by van der Waals force) between the groups, leading to better mixing thereof, more protection of the sites on the PAO molecule prone to oxidation, and hence more pronounced improvement in oxidation stability of the blend.

Thus, it is desired that in the blend of the preset invention, the longest 5% of the pendant groups of all of the molecules of the PAO base stock have an average pendent group length of Lpg(5%); the longest 5% of all of the side chain groups of all of the molecules of the alkylated aromatic base stock have an average side chain group length of Lsc(5%); and |Lsc(5%)−Lpg(5%)|≤D, where D can be 8.0, 7.8, 7.6, 7.5, 7.4, 7.2, 7.0, 6.8, 6.6, 6.5, 6.4, 6.2, 6.0, 5.8, 5.6, 5.5, 5.4, 5.2, 5.0, 4.8, 4.6, 4.4, 4.2, 4.0, 3.8, 3.6, 3.5, 3.4, 3.2, 3.0, 2.8, 2.6, 2.5, 2.4, 2.2, 2.0, 1.8, 1.6, 1.5, 1.4, 1.2, 1.0, 0.8, 0.6, 0.5, 0.4, 0.2, 0. Preferably Lsc(5%)>Lpg(5%).

It is further desired that in the blend of the preset invention, the longest 10% of the pendant groups of all of the molecules of the PAO base stock have an average pendent group length of Lpg(10%); the longest 10% of all of the side chain groups of all of the molecules of the alkylated aromatic base stock have an average side chain group length of Lsc(10%); and |Lsc(10%)−Lpg(10%)|≤D, where D can be 8.0, 7.8, 7.6, 7.5, 7.4, 7.2, 7.0, 6.8, 6.6, 6.5, 6.4, 6.2, 6.0, 5.8, 5.6, 5.5, 5.4, 5.2, 5.0, 4.8, 4.6, 4.4, 4.2, 4.0, 3.8, 3.6, 3.5, 3.4, 3.2, 3.0, 2.8, 2.6, 2.5, 2.4, 2.2, 2.0, 1.8, 1.6, 1.5, 1.4, 1.2, 1.0, 0.8, 0.6, 0.5, 0.4, 0.2, 0. Preferably Lsc(10%)>Lpg(10%).

It is further desired that in the blend of the preset invention, the longest 20% of the pendant groups of all of the molecules of the PAO base stock have an average pendent group length of Lpg(20%); the longest 20% of all of the side chain groups of all of the molecules of the alkylated aromatic base stock have an average side chain group length of Lsc(20%); and |Lsc(20%)−Lpg(20%)|≤D, where D can be 8.0, 7.8, 7.6, 7.5, 7.4, 7.2, 7.0, 6.8, 6.6, 6.5, 6.4, 6.2, 6.0, 5.8, 5.6, 5.5, 5.4, 5.2, 5.0, 4.8, 4.6, 4.4, 4.2, 4.0, 3.8, 3.6, 3.5, 3.4, 3.2, 3.0, 2.8, 2.6, 2.5, 2.4, 2.2, 2.0, 1.8, 1.6, 1.5, 1.4, 1.2, 1.0, 0.8, 0.6, 0.5, 0.4, 0.2, 0. Preferably Lsc(20%)>Lpg(20%).

It is further desired that in the blend of the preset invention, the longest 40% of the pendant groups of all of the molecules of the PAO base stock have an average pendent group length of Lpg(40%); the longest 40% of all of the side chain groups of all of the molecules of the alkylated aromatic base stock have an average side chain group length of Lsc(40%); and |Lsc(40%)−Lpg(40%)|≤D, where D can be 8.0, 7.8, 7.6, 7.5, 7.4, 7.2, 7.0, 6.8, 6.6, 6.5, 6.4, 6.2, 6.0, 5.8, 5.6, 5.5, 5.4, 5.2, 5.0, 4.8, 4.6, 4.4, 4.2, 4.0, 3.8, 3.6, 3.5, 3.4, 3.2, 3.0, 2.8, 2.6, 2.5, 2.4, 2.2, 2.0, 1.8, 1.6, 1.5, 1.4, 1.2, 1.0, 0.8, 0.6, 0.5, 0.4, 0.2, 0. Preferably Lsc(40%)>Lpg(40%).

It is further desired that in the blend of the preset invention, the longest 50% of the pendant groups of all of the molecules of the PAO base stock have an average pendent group length of Lpg(50%); the longest 50% of all of the side chain groups of all of the molecules of the alkylated aromatic base stock have an average side chain group length of Lsc(50%); and |Lsc(50%)−Lpg(50%)|≤D, where D can be 8.0, 7.8, 7.6, 7.5, 7.4, 7.2, 7.0, 6.8, 6.6, 6.5, 6.4, 6.2, 6.0, 5.8, 5.6, 5.5, 5.4, 5.2, 5.0, 4.8, 4.6, 4.4, 4.2, 4.0, 3.8, 3.6, 3.5, 3.4, 3.2, 3.0, 2.8, 2.6, 2.5, 2.4, 2.2, 2.0, 1.8, 1.6, 1.5, 1.4, 1.2, 1.0, 0.8, 0.6, 0.5, 0.4, 0.2, 0. Preferably Lsc(50%)>Lpg(50%).

It is further desired that in the blend of the preset invention, the entirety of the pendant groups of all of the molecules of the PAO base stock have an average pendent group length of Lpg(100%); the entirety of all of the side chain groups of all of the molecules of the alkylated aromatic base stock have an average side chain group length of Lsc(100%); and |Lsc(100%)−Lpg(100%)|≤D, where D can be 8.0, 7.8, 7.6, 7.5, 7.4, 7.2, 7.0, 6.8, 6.6, 6.5, 6.4, 6.2, 6.0, 5.8, 5.6, 5.5, 5.4, 5.2, 5.0, 4.8, 4.6, 4.4, 4.2, 4.0, 3.8, 3.6, 3.5, 3.4, 3.2, 3.0, 2.8, 2.6, 2.5, 2.4, 2.2, 2.0, 1.8, 1.6, 1.5, 1.4, 1.2, 1.0, 0.8, 0.6, 0.5, 0.4, 0.2, 0. Preferably Lsc(100%)>Lpg(100%).

Typically, in the polymerization of linear alpha olefins (LAOS) using a metallocene catalyst system for making PAOs (metallocene PAOs, "mPAOs"), isomerization of the LAOs and oligomers causing mobility of the carbon-carbon double bonds can be avoided. On the contrary, when conventional non-metallocene catalyst systems such as Lewis acid-based catalysts (such as Friedel-Crafts catalysts) are used in the polymerization step, appreciable isomerization can occur. As a result, mPAOs tend to have significantly fewer short pendant groups (methyl, ethyl, C3, C4, and the like) attached to the carbon backbone thereof, in contrast to the large quantities of such short pendant groups on the carbon backbone of conventional PAOs (cPAOs). Thus, if the same LAOs are used as the monomer(s), mPAOs tend to have significantly longer Lpg(10%), Lpg(20%), Lpg(40%), Lpg(50%), and even Lpg(100%) than cPAOs. Assuming AA base stock with Lsc(10%), Lsc(20%), Lsc(20%), Lsc(40%), Lsc(50%), and Lsc(100%) is blended with the PAO, where at least one of the following conditions is met: Lsc(10%)≥Lpg(10%), Lsc(20%)≥Lpg(20%), Lsc(40%)≥Lpg(40%), Lsc(50%)≥Lpg(50%), and Lsc(100%)≥Lsc(100%), an mPAO blend would be preferred over a cPAO base stock for the purpose of the present invention.

A regio-regular structure of the PAO used for the blend of the present invention can also facilitate the alignment, interaction and affinity of the pendant groups and the side chain groups. To that end, it is preferred that at least 50%, or 60%, 70%, 80%, 90%, 95%, even 99% of all of the pendant groups attached to the carbon backbone of the PAO molecules are regio-regular, i.e., at least 50%, or 60%, 70%, 80%, 90%, 95%, even 99% of the triads on the PAO structure are (m,m) triads or (m,$) triads. Preferably, the PAO molecules are essentially isotactic or syndiotactic.

The weight percentage of the PAO base stock relative to the total weight of all PAO base stock(s) and all AA base stock(s) in the blend can range from: (I) P(PAO)1 wt % to P(PAO)2 wt %, where P(PAO)1 and P(PAO)2 can be, independently, 10, 15, 20, 25, 30, 35, 40, 45, 50, 55, 60, 65, 70, 75, 80, 85, 90, 92, 94, 95, 96, 98, or 99, as long as P(PAO)1<P(PAO)2; (II) preferably from 25 wt % to 95 wt %; (III) more preferably from 30 wt % to 90 wt %; (IV) still more preferably from 35 wt % to 90 wt %; (V) still more preferably from 40% to 90 wt %; and (VI) most preferably from 50 wt % to 85 wt %. It was found that when the weight percentage of the PAO base stocks relative to the total weight of all PAO base stocks and AN base stocks in the blend is in the range of about 70 wt % to 80 wt %, the most pronounced synergistic effect (i.e., improvement) in oxidation stability is observed.

The mole percentage of the PAO base stock relative to the total moles of all PAO base stock(s) and all AA base stock(s) in the blend can range from (I) P(PAO)3 mol % to P(PAO)4 mol %, where P(PAO)3 and P(PAO)4 can be, independently, 10, 15, 20, 25, 30, 35, 40, 45, 50, 55, 60, 65, 70, 75, 80, 85, 90, 92, 94, 95, 96, 98, or 99, as long as P(PAO)3<P(PAO)4; (II) preferably from 20 mol % to 90 mol %; (III) more preferably from 25 mol % to 90 mol %; (IV) still more preferably from 30 mol % to 90 mol %; (V) still more preferably from 40 mol % to 90 mol %; and (VI) most preferably from 50 mol % to 80 mol %. Alternatively, molar ratio of the PAO molecules to AN molecules is in a range from R(1) to R(2), where R(1) and R(2) can be, independently, 1, 1.2, 1.4, 1.5, 1.6, 1.8, 2.0, 2.2, 2.4, 2.5, 2.6, 2.8, 3.0, 3.5, 4.0, 4.5, 5.0, 5.5, 6.0, 7.0, 8.0, 9.0, 10.0, as long as R(1)<R(2).

It has also been found that in the blend of the present invention, where each PAO molecule is aligned with a larger number of AA molecules, the improvement of oxidation stability increases accordingly. Again, without intending to be bound by a particular theory, it is believed that a larger number of AA molecules aligned with the backbone of a PAO molecule tends to provide better protection of sites prone to oxidation, better intermixing between the PAO and AA molecules, and stronger affinity between them, all resulting in higher improvement in oxidation stability.

Oxidation stability of a base stock material can be measured by using ASTM D2272 which reports a RPVOT time in minutes. The longer the RPVOT, the more resistant the base stock material is to the accelerated oxidation testing conditions. The enhanced improvement in oxidation stability of the base stock blend of the present invention is reflected by the measured RPVOT values. Thus, the blend of the present invention exhibits an oxidation stability (measured RPVOT value) equal to aa*OS(ref), where OS(ref) is calculated pursuant to the following equation:

$$OS(ref) = OS(AA) \times \frac{W(AA)}{W(AA) + W(PAO)} + OS(PAO) \times \frac{W(PAO)}{W(AA) + W(PAO)},$$

where OS(AA) and OS(PAO) are the oxidation stability (RPVOT values) of the alkylated aromatic base stock and the PAO base stock, respectively, and W(AA) and W(PAO) are weight of the alkylated aromatic base stock and weight of the PAO base stock in the blend, respectively, and aa is a number in a range from aa1 to aa2, where aa1 and aa2 can be, independently, 1.05, 1.06, 1.07, 1.08, 1.09, 1.10, 1.12, 1.14, 1.15, 1.16, 1.18, 1.20, 1.22, 1.24, 1.25, 1.26, 1.28, 1.30, 1.32, 1.34, 1.35, 1.36, 1.38, 1.40, 1.42, 1.44, 1.45, 1.46, 1.48, 1.50, 1.52, 1.54, 1.55, 1.56, 1.58, 1.60, 1.62, 1.64, 1.65, 1.66, 1.68, 1.70, 1.72, 1.74, 1.75, 1.76, 1.77, 1.78, 1.80, 1.82, 1.84, 1.85, 1.86, 1.88, 1.90, 1.92, 1.94, 1.95, 1.96, 1.98, 2.00, as long as aa1<aa2. Thus, the synergistic effect of the PAO and AA base stock blends in terms of improvement in oxidation stability can be quite significant.

The lubricant can also include any one or more additives as is common in the art. In one embodiment, the lubricant comprises one or more additives, such as oxidation inhibitors, antioxidants, dispersants, detergents, corrosion inhibitors, rust inhibitors, metal deactivators, anti-wear agents, extreme pressure additives, anti-seizure agents, non-olefin based pour point depressants, wax modifiers, viscosity index improvers, viscosity modifiers, fluid-loss additives, seal compatibility agents, friction modifiers, lubricity agents, anti-staining agents, chromophoric agents, defoamants, demulsifiers, emulsifiers, densifiers, wetting agents, gelling agents, tackiness agents, colorants, and blends thereof.

Due to the enhanced improvement in oxidation stability of the base stock blend of the present invention, a lubricant composition incorporating the blend would have improve oxidation stability while maintaining the same quantity of antioxidants added therein. This can reduced the overall cost of the lubricant and negative effect on the overall performance of the lubricant as a result of the use of overally high concentrations of antioxidants. Alternatively, the life of the lubricant, and hence drain interval thereof, can be extended while maintaining the same quantity of antioxidant included therein. Thus, the blend may comprise an antioxidant at a concentration in the range from C(ao)1 ppm to C(ao)2 ppm, based on the total weight of the PAO base stock and the AA base stock, where C(ao)1 and C(ao)2 can be, independently, 0, 1, 5, 10, 20, 30, 40, 50, 60, 70, 80, 90, 100, 110, 120, 130, 140, 150, 160, 170, 180, 190, 200, as long as C(ao)1<C(ao)2.

Desirably, the blend of the present invention has an overall bromine number in the range from Nb(bl)1 to Nb(bl)2, where Nb(bl)1 and Nb(bl)2 can be, independently, 0, 0.2, 0.4, 0.5, 0.6, 0.8, 1.0, 1.5, 2.0, 2.5, 3.0, 3.5, 4.0, 4.5, 5.0, as long as NB(bl)1<Nb(bl)2.

The present invention is further illustrated by the following non-limiting examples.

Examples

A series of PAO base stocks (P1-P13), listed in TABLE I, were fabricated by polymerizing various LAO feed compositions in the presence of various polymerization catalyst systems.

Among these, P1-P10 were fabricated by using a metallocene catalyst system and hence identified as mPAOs. Examples of such metallocene catalyst systems are described in, e.g., WO 2009/123800 A1 (Hagemeister et al.).

P11 was fabricated by using a chromium oxide-based catalyst system and hence identified as chPAO. Examples of such chromium oxide-based catalyst system are described in, e.g., U.S. Pat. No. 4,827,073 (Wu); U.S. Pat. No. 4,827,064 (Wu); U.S. Pat. No. 4,967,032 (Ho et al.); U.S. Pat. No. 4,926,004 (Pelrin et al.); and U.S. Pat. No. 4,914,254 (Pelrine).

P12 and P13 were fabricated by using conventional, non-chromium-based, non-metallocene catalyst systems and hence identified as cPAOs. Examples of such non-metallocene catalysts are described in, e.g., WO2007/011459 (Wu et al.).

All of the PAO base stock samples P1-P13 were hydrogenated after polymerization such that the bromine numbers thereof were at most 3.0.

The mPAOs and the chPAO showed virtually no isomerization of the LAO monomer molecules and the oligomer molecules during polymerization. The specific mPAOs have substantially isotactic polymer structures, i.e., essentially all of the pendant groups, except for one methyl group, are located on the same side of the carbon backbone, as a result of the specific metallocene catalyst system used. The pendant groups attached to the final mPAO molecules, except for the one methyl group, have defined lengths corresponding to the LAO monomers used, typically comprising n−2 carbons, where n is the number of carbon atoms in the LAO monomer molecules. On the other hand, as a result of the use of conventional catalyst systems, substantial isomerization of the LAO monomer molecules and/or the oligomer molecules occurred during the polymerization, leading to the formation of multiple, short pendent groups attached to the carbon backbones of the final cPAO molecules. The types of the pendant groups attached to the backbones of the cPAO molecules can comprise any number of carbon atoms ranging from 1 to n−2, where n is the total number carbon atoms in the LAO monomer molecules. In addition, the short-chain pendant groups are distributed randomly on different sides of the carbon backbone, resulting in a substantially atactic molecular structure of the final cPAO molecules. Because of the isomerization reactions, the average pendent group lengths of the longest 5%, 10%, 20%, 40%, 50%, and 100%, of the cPAO molecules tend to be much shorter than those in the mPAO molecules made from the same monomers, as is clearly demonstrated by the data in TABLE I.

A series of blends of base stocks (B1-B13), with various compositions shown in TABLE II, were made by mixing the above PAO base stocks with an alkylated naphthalene base stock having a kinematic viscosity at 100° C. (KV100) of about 5 cSt. In all blends B1-B13, the AN base stock has an average side chain group length (Lsc) at the longest 5%, 10%, 20%, 40%, 50%, and 100% thereof of about 16, 16, 16, 16, 16, 15.5, respectively.

The blends B1-B13 were then tested for their oxidation stability using the procedure of ASTM D2272. The pure AN base stock used in the current examples has a RPVOT about 250 minutes that varies slightly from batch to batch, while the pure PAO base stocks tested in the current examples generally has a RPVOT of less than about 50 minutes that varies slightly from batch to batch. The tested results are reported as RPVOT values (in minutes) in FIGS. 1 and 2 and TABLE II. FIG. 2 shows the same set of data in FIG. 1 where the weight ratio of the PAO base stock to the AN base stock is 75/25. Synergistic effect in RPVOT values resulting from the mixing the PAO base stocks with the AN base stock is apparent from the data.

Figure 2:
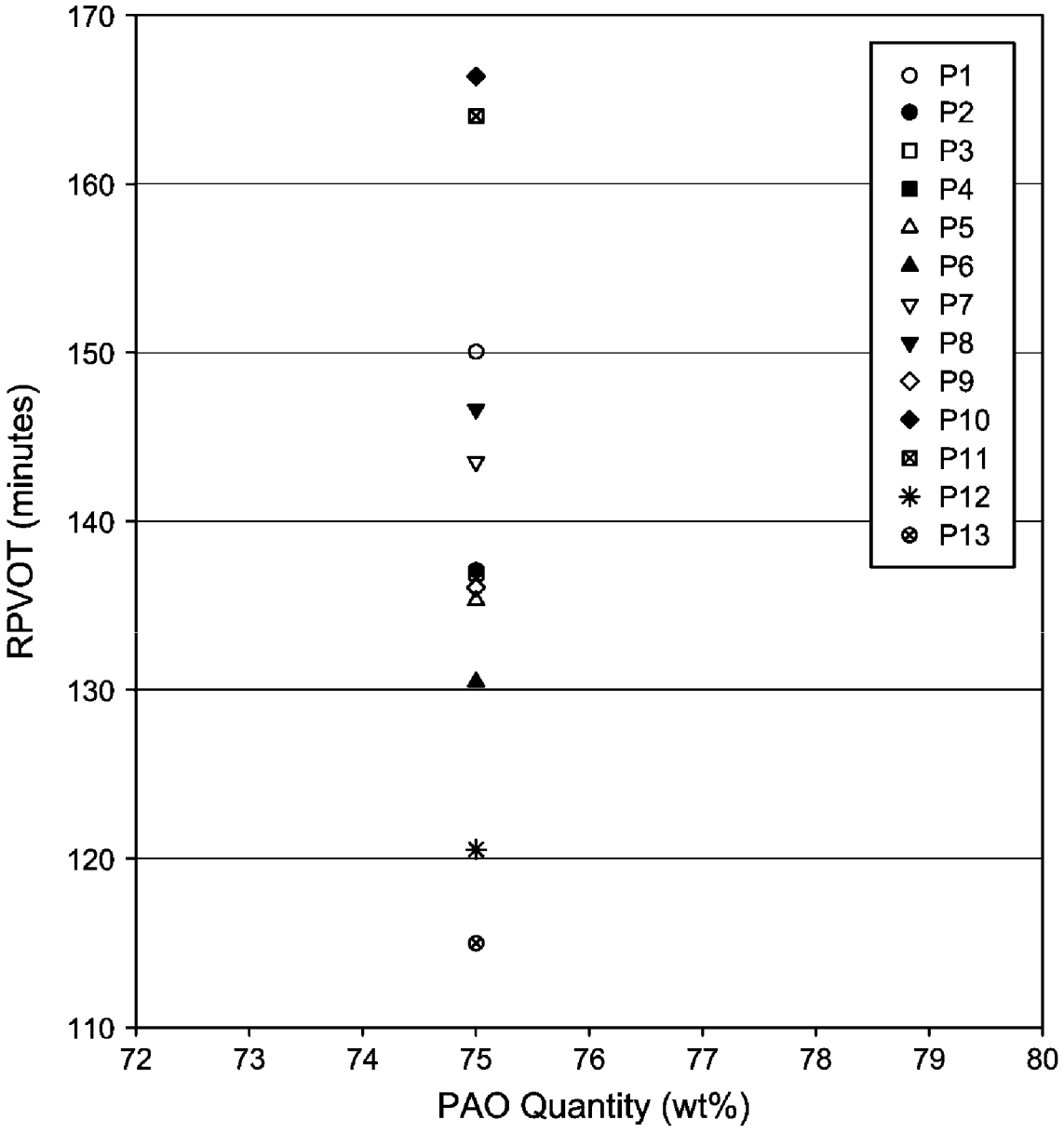
FIG. 2 is a diagram showing oxidation stability performance of a series of lubricant base stock blends comprising a PAO base stock and an AN base stock with a PAO/AN weight ratio of 75/25.

As can be clearly seen from FIGS. 1 and 2:

(1) For PAO base stocks (P1, P4, P7, P8, and P10) with the smallest values of Lsc(5%)−Lpg(5%), Lsc(10%)−Lpg(10%), Lsc(20%)−Lpg(20%), and Lsc(40%)−Lpg(40%) (i.e., differences of the average of the longest 10%, 20%, and 40% (by mole), respectively, side chain group length of the AN base stock and the average of the longest 10%, 20%, and 40% (by mole), respectively, pendant group length of the PAO base stock), their blends (B1, B4, B7, and B10) with the AN base stock at weight ratio of 75/25 showed the highest oxidation stability improvement.

(2) For PAO base stocks (B12 and B13) with the largest values of Lsc(5%)−Lpg(5%), Lsc(10%)−Lpg(10%), Lsc(20%)−Lpg(20%), and Lsc(40%)−Lpg(40%), their blends (B12 and B13) with the AN base stock at weight ratio of 75/25 showed the lowest oxidation stability improvement.

(3) Among the mPAO base stocks, those (P1, P4, P7, P8, and P10) comprising C12 pendant groups (derived from the C14 feed component) as the longest 10% pendant groups showed higher oxidation stability improvement compared to those (P3 and P6) comprising C10 pendant groups (derived from the C12 feed component) as the longest 10% pendant groups in their respective blends with the AN base stock.

(4) Among the mPAO base stocks, those (P3 and P6) comprising C10 pendant groups (derived from the C12 feed component) as the longest 10% pendant groups showed higher oxidation stability improvement compared to those (P2, P5, and P9) comprising C8 groups (derived from the C10 feed component) as the longest 10% pendant groups in their respective blends with the AN base stock.

(5) Among the mPAO base stocks, the one with higher viscosity (P11, with a KV100 of about 150 cSt) showed much higher oxidation stability improvement compared to the ones with lower viscosity (P1, P4, P7, and P8, all with a KV100 in the range from 40 to 60) when mixed with the AN base stock at PAO/AN weight ratios of 50/50 and 75/25. Without intending to be bound by a particular theory, it is believed this is because P11 has a much longer carbon backbone, resulting in each PAO molecule mixed with significantly more AN molecules, which provide more and better protection for the PAO molecule.

(6) The blends (B1 to B11) of (a) mPAOs or chPAO base stocks (P1 to P11) with (b) AN base stock showed significantly higher oxidation stability compared to the blends (B12 and B13) of cPAO base stocks (P12 and P13) with AN base stock. Without intending to be bound by a particular theory, it is believed this is largely due to: (i) the significantly shorter average pendant group lengths of the cPAO molecules among the 10%, 20%, 40%, and 50% longest, and 100% of the pendant groups on the cPAO molecules, as a result of isomerization of the olefin molecules during polymerization using conventional catalyst systems, which is largely avoided when using the metallocene catalyst system in the current examples; and (ii) the more orderly molecule structures of the mPAO base stock, which provides better and higher degree of mixing of the PAO molecules with the AN molecules.

These results clearly demonstrate that (a) the closer the length of the longest side chain groups attached to the aromatic nuclei of the AN base stock molecules and the length of the longest pendant groups attached to the carbon backbone of the PAO molecules, the higher the synergistic effect in terms of oxidation stability improvement in the blend; and (b) the more regular structure of mPAO molecules also benefits the oxidation stability improvement in the blend. This phenomenon has not been observed previously. Without intending to be bound by a particular theory, it is believed that the presence of longer pendant groups on the carbon backbone of the PAO molecules (which are closer to the side chain groups on the AN molecules in length) and regular distribution thereof on the carbon backbone allow for more intimate and stronger interaction (Van der Waals force, e.g.) between the pendent groups and the side chain groups, resulting in better intermixing of the AN molecules and the PAO molecules, and better protection of the sites on the PAO molecules and AN molecules that are vulnerable to oxidation. Moreover, within a PAO/AN weight ratio from, e.g., 0.25 to 0.90, more AN molecules aligned with each PAO molecule tend to benefit the oxidation stability improvement in the blend as well.

TABLE I

| Base Stock | | LAO Feed Composition (%) | | | | | | | | | | LAO |
|---|---|---|---|---|---|---|---|---|---|---|---|---|
| | | C6 | | C8 | | C10 | | C12 | | C14 | | |
| No. | Type | wt | mol | wt | mol | wt | mol | wt | mol | wt | mol | Units |
| P1 | mPAO | — | — | 70 | 80 | — | — | — | — | 30 | 20 | 21 |
| P2 | mPAO | — | — | 55 | 60 | 45 | 40 | — | — | — | — | 24 |
| P3 | mPAO | — | — | 80 | 86 | — | — | 20 | 14 | — | — | 24 |
| P4 | mPAO | — | — | 80 | 88 | — | — | — | — | 20 | 13 | 23 |
| P5 | mPAO | — | — | 35 | 40 | 65 | 60 | — | — | — | — | 23 |
| P6 | mPAO | — | — | 40 | 47 | 40 | 38 | 20 | 16 | — | — | 22 |
| P7 | mPAO | — | — | 40 | 48 | 40 | 38 | — | — | 20 | 14 | 21 |
| P8 | mPAO | 25 | 37 | — | — | 60 | 53 | — | — | 15 | 10 | 22 |
| P9 | mPAO | 20 | 29 | — | — | 80 | 71 | — | — | — | — | 23 |
| P10 | mPAO | 25 | 37 | — | — | 60 | 53 | — | — | 15 | 10 | 34 |
| P11 | chPAO | — | — | — | — | 100 | 100 | — | — | — | — | 32 |
| P12 | cPAO | — | — | 50 | 60 | — | — | 50 | 40 | — | — | 25 |
| P13 | cPAO | — | — | 50 | 60 | — | — | 50 | 40 | — | — | 16 |

TABLE I-continued

| Base Stock | | Pendant Groups | | | | | | |
|---|---|---|---|---|---|---|---|---|
| | | Average pendant group length of the longest | | | | | | |
| No. | Type | 5% | 10% | 20% | 40% | 50% | 100% | Types |
| P1 | mPAO | 12.0 | 12.0 | 12.0 | 9.0 | 8.4 | 7.5 | C1; C6; C12 |
| P2 | mPAO | 8.0 | 8.0 | 8.0 | 8.0 | 7.6 | 6.7 | C1; C6; C8 |
| P3 | mPAO | 10.0 | 10.0 | 8.8 | 7.4 | 7.1 | 6.6 | C1; C6; C10 |
| P4 | mPAO | 12.0 | 12.0 | 9.9 | 8.0 | 7.6 | 6.9 | C1; C6; C12 |
| P5 | mPAO | 8.0 | 8.0 | 8.0 | 8.0 | 8.0 | 7.0 | C1; C6; C8 |
| P6 | mPAO | 10.0 | 10.0 | 9.6 | 8.8 | 8.6 | 7.3 | C1; C6; C8; C10 |
| P7 | mPAO | 12.0 | 12.0 | 10.8 | 9.4 | 9.1 | 7.7 | C1; C6; C8; C12 |
| P8 | mPAO | 12.0 | 12.0 | 10.0 | 9.0 | 8.8 | 7.3 | C1; C4; C8; C12 |
| P9 | mPAO | 8.0 | 8.0 | 8.0 | 8.0 | 8.0 | 6.9 | C1; C4; C8; |
| P10 | mPAO | 12.0 | 12.0 | 10.0 | 9.0 | 8.8 | 7.4 | C1; C4; C8; C12 |
| P11 | chPAO | 8.0 | 8.0 | 8.0 | 8.0 | 8.0 | 7.8 | C1; C8 |
| P12 | cPAO | 5.0 | 5.0 | 5.0 | 4.5 | 4.5 | 4.0 | C1; C2; C3; C4; C5; C6; C7; C8; C9; C10 |
| P13 | cPAO | 5.0 | 5.0 | 5.0 | 4.5 | 4.5 | 4.0 | C1; C2; C3; C4; C5; C6; C7; C8; C9; C10 |

TABLE II

| | PAO Base Stock | | | | AN Base Stock | | Blend Properties | | | | | | | | |
|---|---|---|---|---|---|---|---|---|---|---|---|---|---|---|---|
| | | | | | | | Expected | Measured | | | | | | | |
| Blend | No. | Type | Wt % | Mol % | Wt % | Mol % | RPVOT | RPVOT | RM − | \|Lsc - Lpg\| at the longest | | | | | |
| No. | — | — | — | — | — | — | (RE) | (RM) | RE | 5% | 10% | 20% | 40% | 50% | 100% |
| B1 | P1 | mPAO | 75 | 30 | 25 | 70 | 89.5 | 150 | 60.5 | 4.0 | 4.0 | 4.0 | 7.0 | 7.6 | 8.0 |
| B2 | P2 | mPAO | 75 | 30 | 25 | 70 | 89.5 | 137 | 47.5 | 8.0 | 8.0 | 8.0 | 8.0 | 8.4 | 8.8 |
| B3 | P3 | mPAO | 75 | 30 | 25 | 70 | 89.5 | 137 | 47.5 | 6.0 | 6.0 | 7.2 | 8.6 | 8.9 | 8.9 |
| B4 | P4 | mPAO | 75 | 30 | 25 | 70 | 89.5 | 136 | 46.5 | 4.0 | 4.0 | 6.1 | 8.1 | 8.4 | 8.6 |
| B5 | P5 | mPAO | 75 | 30 | 25 | 70 | 89.5 | 136 | 46.5 | 8.0 | 8.0 | 8.0 | 8.0 | 8.0 | 8.5 |
| B6 | P6 | mPAO | 75 | 30 | 25 | 70 | 89.5 | 131 | 41.5 | 6.0 | 6.0 | 6.4 | 7.2 | 7.4 | 8.2 |
| B7 | P7 | mPAO | 75 | 30 | 25 | 70 | 89.5 | 144 | 54.5 | 4.0 | 4.0 | 5.2 | 6.6 | 6.9 | 7.8 |
| B8 | P8 | mPAO | 75 | 30 | 25 | 70 | 89.5 | 147 | 57.5 | 4.0 | 4.0 | 6.0 | 7.0 | 7.2 | 8.2 |
| B9 | P9 | mPAO | 75 | 30 | 25 | 70 | 89.5 | 136 | 46.5 | 8.0 | 8.0 | 8.0 | 8.0 | 8.0 | 8.6 |
| B10 | P10 | mPAO | 75 | 20 | 25 | 80 | 89.5 | 167 | 77.5 | 4.0 | 4.0 | 6.0 | 7.0 | 7.2 | 8.1 |
| B11 | P11 | chPAO | 75 | 20 | 25 | 80 | 89.5 | 164 | 74.5 | 8.0 | 8.0 | 8.0 | 8.0 | 8.0 | 7.7 |
| B12 | P12 | cPAO | 75 | 30 | 25 | 70 | 89.5 | 121 | 31.5 | 11.0 | 11.0 | 11.0 | 11.5 | 11.5 | 11.5 |
| B13 | P13 | cPAO | 75 | 40 | 25 | 60 | 89.5 | 115 | 25.5 | 11.0 | 11.0 | 11.0 | 11.5 | 11.5 | 11.5 |

The invention claimed is:

1. A lubricant base stock blend comprising a PAO base stock made using a metallocene or supported chromium oxide catalyst and an alkylated aromatic base stock, wherein:

each molecule of the PAO base stock comprises a plurality of pendant groups, where at least 50% of the pendant groups on the PAO molecules are regio-regular;

the longest 5%, by mole, of the pendant groups of all of the molecules of the PAO base stock have an average pendant group length of Lpg(5%);

each molecule of the alkylated aromatic base stock comprises one or more side chain group;

the longest 5%, by mole, of all of the side chain groups of all of the molecules of the alkylated aromatic base stock have an average side chain group length of Lsc(5%); and the difference between Lsc(5%) and Lpg(5%) is at most 8.0.

2. The lubricant base stock blend of claim 1, wherein:

the longest 10%, 20%, 40%, 50%, and 100%, by mole, of the pendant groups of all of the molecules of the PAO base stock have an average pendant group length of Lpg(10%), Lpg(20%), Lpg(40%), Lpg(50%), and Lpg (100%), respectively;

the longest 10%, 20%, 40%, 50%, and 100%, by mole, of all of the side chain groups of all of the molecules of the alkylated aromatic base stock have an average side chain group length of Lsc(10%), Lsc(20%), Lsc(40%), Lsc(50%), and Lsc(100%), respectively; and at least one of the following conditions is met:

(i) $|Lsc(10\%)-Lpg(10\%)|\leq 8.0$;

(ii) $|Lsc(20\%)-Lpg(20\%)|\leq 8.0$;

(iii) $|Lsc(40\%)-Lpg(40\%)|\leq 8.5$;

(iv) $|Lsc(50\%)-Lpg(50\%)|\leq 9.0$; and (v) $|Lsc(100\%)-Lpg(100\%)|\leq 9.5$.

3. The lubricant base stock blend of claim 1, wherein at least one of the following conditions is met:

(i) $Lsc(5\%)\geq Lpg(5\%)$;

(ii) $Lsc(10\%)\geq Lpg(10\%)$;

(iii) $Lsc(20\%)\geq Lpg(20\%)$;

(iv) $Lsc(40\%)\geq Lpg(40\%)$;

(v) $Lsc(50\%)\geq Lpg(50\%)$; and (vi) $Lsc(100\%)\geq Lpg(100\%)$.

4. The lubricant base stock blend of claim 1, wherein at least one of the following conditions is met:

(i) 7.0≤Lpg(5%)≤12.0;

(ii) 7.0≤Lpg(10%)≤12.0;

(iii) 6.5≤Lpg(20%)≤11.0;

(iv) 6.0≤Lpg(40%)≤11.0;

(v) 5.5≤Lpg(50%)≤9.5; and (vi) 5.0≤Lpg(100%)≤9.0.

5. The lubricant base stock blend of claim 1, wherein at least 60% of the pendant groups on the PAO molecules in the PAO base stock have a pendent group length of at least 6.

6. The lubricant base stock blend of claim 4, wherein at least 90% of the pendent groups on the PAO molecules in the PAO base stock have a pendant group length of at least 6.

7. The lubricant base stock blend of claim 1, wherein at least 60% of the pendant groups on the PAO molecules have a pendent group length of at least 8.

8. The lubricant base stock blend of claim 6, wherein at least 90% of the pendant groups on the PAO molecules have a pendent group length of at least 8.

9. The lubricant base stock blend of claim 1, wherein the PAO base stock is produced from at least one alpha olefin comprising at least 8 carbon atoms in the presence of a metallocene catalyst.

10. The lubricant base stock blend of claim 1, wherein the alkylated aromatic base stock comprises an alkylated naphthalene base stock.

11. The lubricant base stock blend of claim 1, wherein at least one of the following conditions is met:

(i) Lsc(5%)≥10;

(ii) Lsc(10%)≥10;

(iii) Lsc(20%)≥10;

(iv) Lsc(40%)≥10;

(v) Lsc(50%)≥10; and (vi) Lsc(100%)≥10.

12. The lubricant base stock blend of claim 1, wherein at least one of the following conditions is met:

(i) 10.0≤Lsc(5%)≤20.0;

(ii) 10.0≤Lsc(10%)≤20.0;

(iii) 11.0≤Lsc(20%)≤19.0;

(iv) 12.0≤Lsc(40%)≤18.0;

(v) 13.0≤Lsc(50%)≤17.0; and (vi) 14.0≤Lsc(100%)≤16.0.

13. The lubricant base stock blend of claim 1, wherein the molar ratio of the PAO molecules to the alkylated aromatic base stock molecules is in a range from 1.0 to 10.0.

14. The lubricant base stock blend of claim 1, wherein the weight ratio of the PAO base stock to the alkylated aromatic base stock is in a range from 0.40 to 0.90.

15. The lubricant base stock blend of claim 1, further having an oxidation stability equal to aa*OS (ret), where OS(ref) is calculated pursuant to the following equation:

$$OS(ref) = OS(AA) \times \frac{W(AA)}{W(AA) + W(PAO)} + OS(PAO) \times \frac{W(PAO)}{W(AA) + W(PAO)},$$

where OS(AA) and OS(PAO) are the oxidation stability of the alkylated aromatic base stock and the PAO base stock, respectively, and W(AA) and W(PAO) are weight of the alkylated aromatic base stock and weight of the PAO base stock in the blend, respectively, and aa is a number in a range from 1.05 to 2.00.

16. The lubricant base stock blend of claim 1, wherein the PAO base stock has a kinematic viscosity at 100° C. in the range from 20 to 1000 cSt.

17. The lubricant base stock blend of claim 1, wherein the PAO base stock is substantially completely hydrogenated.

18. The lubricant base stock blend of claim 1, wherein the PAO base stock has a bromine number in the range from 0 to 3.0.

19. The lubricant base stock blend of claim 1, wherein the alkylated aromatic base stock has a bromine number in the range from 0 to 2.0.

20. The lubricant base stock blend of claim 1, wherein the lubricant base stock blend has a bromine number in the range from 0 to 3.0.

21. The lubricant base stock blend of claim 1, further comprising an antioxidant at a concentration in the range from 1 ppm to 150 ppm.

22. A method for producing a lubricant base stock blend with improved oxidation stability, comprising blending a PAO base stock with an alkylated aromatic base stock with the features stated in claim 1.

23. A composition of matter comprising a lubricant base stock blend according to claim 1.

24. The lubricant base stock blend of claim 1, where at least 70% of the pendant groups on the PAO molecules are regio-regular.

25. The lubricant base stock blend of claim 1, where at least 90% of the pendant groups on the PAO molecules are regio-regular.

* * * * *